US005555957A

United States Patent [19]

Dreher et al.

[11] Patent Number: 5,555,957

[45] Date of Patent: Sep. 17, 1996

[54] CONTROL SYSTEM FOR A MATERIALS-HANDLING DEVICE, ESPECIALLY FOR A SHELF STORAGE AND RETRIEVAL DEVICE

[75] Inventors: Herbert Dreher, Witten; Michael Hülsmann, Herdecke; Anton Münzebrock; Guiliano Persico, both of Dortmund, all of Germany

[73] Assignee: Mannesmann Aktiengesellschaft, Dusseldorf, Germany

[21] Appl. No.: 423,163

[22] Filed: Apr. 17, 1995

[30] Foreign Application Priority Data

Apr. 15, 1994 [DE] Germany ..... 44 13 538.6

[51] Int. Cl.[6] ..... B66F 9/20

[52] U.S. Cl. ..... 187/233; 187/289

[58] Field of Search ..... 187/222, 233, 187/224, 289, 290; 414/266, 279, 281

[56] References Cited

U.S. PATENT DOCUMENTS 3,636,883 1/1972 Wesener ..... 104/50
5,074,384 12/1991 Nakai et al. ..... 187/289
5,433,292 7/1995 Haymore et al. ..... 187/240

FOREIGN PATENT DOCUMENTS 1294876 6/1973 Germany .
2206203 8/1973 Germany .

OTHER PUBLICATIONS

"Lagerbediengeräte", by Markbold Lager dated 1980 (pp. 23–24), fördern und heben, 1980 Marktbildlager.

*Primary Examiner*—Kenneth Noland
*Attorney, Agent, or Firm*—Cohen, Pontani, Lieberman, Pavane

[57] ABSTRACT

A control system for a materials-handling device, especially for a shelf storage and retrieval device. The device includes a horizontal travelling mechanism having a horizontal drive; a lift truck which can be raised and lowered on a mast via a lifting drive; and a storage/retrieval drive for storage and/or retrieval of the goods to be handled. The present system provides a simplified assembly and a design with respect to the supply of current. The simplified assembly and design is accompanied by supplying the electrical power for the storage/retrieval drive and for data transmission with a signal converter through the use of contact conductors arranged on the mast and the power is picked up from the contact conductors by sliding contacts on the lift truck.

18 Claims, 4 Drawing Sheets

CONTROL SYSTEM FOR A MATERIALS-HANDLING DEVICE, ESPECIALLY FOR A SHELF STORAGE AND RETRIEVAL DEVICE

BACKGROUND OF THE INVENTION

1. Field of the Invention

The present invention relates to a control system for a materials-handling device, especially for a shelf storage and retrieval device, including a horizontal travelling mechanism having a horizontal drive (x); a lift truck, which can be raised and lowered on a mast via a lifting drive (y); and a storage/retrieval drive (z) for storage or retrieval of the material to be handled.

2. Description of the Prior Art

Rail-mounted materials-handling devices for the transport, storage and retrieval of unit loads, e.g., pallets in shelf warehouses, are well known. The transport and warehousing operations of the storage and retrieval device are carried out along a passageway, the longitudinal sides of which each form a shelf. The storage and retrieval device is equipped with a travelling drive in the x-direction and a lifting drive in the y-direction for transporting the unit load along the shelf. The storage and retrieval of the unit load on and from the shelf is carried out by a driven telescopic or drawing device which works in the z-direction and is positioned on the lifting device moved by the lifting drive.

The travelling drive moves the device on the travelling rail along the length of the shelf. The lift truck is run on a mast of shelf height, and is raised or lowered using a support device, e.g., cable or chain.

A control job for the automatic sequence of transport and storage operations includes essentially position control for the travelling and lifting devices and position and process control during the storage and retrieval process carried out by the load holding device on the lifting device.

The drives and associated sensors for the movement sequences are concentrated locally on the travelling unit and the lifting device. The necessary electrical signal connections and the motor feed line are run via the mast, which is otherwise needed only for mechanical support and guidance functions. According to the prior art, these electrical connections are established by cable lines between the travelling unit and the lifting device. Trailing cable connections of this type can have up to 140 leads and require high installation expenditure. In addition, such a structure entails great expense for cabling to the height-adjustable lifting device. In cable connections between the lifting device and the mast, on the one hand, and between the mast and the travelling unit, on the other, the establishment of control can be terminated only in connection with the mast. Given the size of the storage and retrieval device, it is important, for reasons related to manufacturing technology and transportation between the manufacturing site and the usage site, to be able to manufacture the lifting device, mast and travelling unit separately and to establish the electric connections at the interfaces of these modules upon assembly. In addition, expenditures for cable lines as used in prior art devices and for their required assembly as well as for the maintenance necessitated by ongoing bending stress are extremely high.

SUMMARY OF THE INVENTION

The present invention is based primarily on providing an economic control system designed to provide automatic shelf storage and retrieval of devices wherein the lifting device, the mast and the travelling unit can be manufactured and transported separately. This eliminates the problems associated with establishing the electrical connections, as the components are assembled and the electrical connections are established by simply fitting the components together through respective connectors. This invention also reduces the number of electrical conductors or leads required.

According to the present invention, the electrical power for both the storage/retrieval drive and the transmission of data by a signal converter can be supplied by contact conductors arranged on the mast. This power can be picked up from the contact conductors arranged on the mast through sliding contacts on the lift truck. The electrical connections between the height-adjustable lifting device and the mast are established via the contact conductors. Using this design, it is therefore possible for the lifting device, the mast and the travelling unit to be manufactured and transported separately and for the electrical connections to be established simply by fitting together the aforementioned components, whereby, in addition, the number of electrical conductors to the lift truck can be significantly reduced. Furthermore, signal currents and motor currents can be run relatively close to one another without impermissible interference.

According to the present invention, spring-activated carbon strips are arranged as sliding contacts on one guidance frame of the lift truck. By means of the exact guidance of the lifting device, the spring-activated carbon strips provide an interruption-free electrical connection between the carbon strip and the contact conductor along the lifting mast. The electrical connection between the lifting device and the mast is established in the course of mounting the lifting device on the mast, without special expenditure related to the contact conductors.

Advantageously, the electrical connection between the mast and the horizontal travelling unit can be established at low cost by means of a connector, arranged on the mast, at the lower end of the contact conductors.

Furthermore, it is also advantageous that the conductive contact-conductor path of a contact conductor at the upper end of the mast and of the same contact conductor or another contact conductor at the lower end of the mast is shortened, so that the conductive segment limits the movement area for raising and/or lowering the lifting device by interrupting a control current circuit. If this area is overtravelled at the ends, a current circuit which had been closed via a connection between a carbon strip and a contact conductor is interrupted in a path-dependent fashion, fulfilling the safety requirement for a movement limiting control, in connection with the contact conductor on the mast, in a simple manner.

The present invention is designed such that the signals of the lifting device are conducted by a signal converter in the vicinity of the carbon strips in such a way that the signal converter includes the conductor connections for the signals, is equipped with signal displays, and converts the parallel signals into a serial data transmission telegram. In this way, the number of necessary contact conductors in the wide range is independent of the number of signals to be transmitted.

As the present invention has a reduced number of loop conductors, it is advantageous to surround the contact conductors carrying the motor currents by protective conductors, so that a screening effect can be maintained with respect to closely adjacent contact conductors for control currents and data transmission signals.

A further feature of the present invention is that the distance between contact conductors, which are rectangular in cross-section, is as small as possible, and the distance from the contact conductors to the conductive mast, with interconnection of an insulating profile, is also as small as possible. In order to achieve the screening effect, the contact conductors have a flat rectangular cross-section, and a constant narrow distance of approximately 2.5 mm between adjacent conductors in the insulating support profile. In addition, the distance to the wall of the mast is small (approximately 12 mm), and the mast is produced from electrically conductive material, e.g. steel, which, when magnetized, additionally screens the magnetic field of the motor currents.

Another feature of the present invention is that the contact conductors consist of parallel adjacent contact conductors for motor currents, control currents and data transmission signals.

As noted above, the shelf storage and retrieval devices are equipped with three main movement axes, namely, the horizontal drive (x), the lifting drive (y) and the storage/retrieval drive (z). Each drive includes a motor, a drive regulator, a speed control and a position control. The movement sequence for the transport and storage function of the shelf storage and retrieval device is carried out by a superordinated control of the drives. However, the electrical line connection between the lifting device and the travelling mechanism with the hook-up to the superordinated control can be established only when, according to further features of the invention, the signals of the lift truck are fed into a signal converter in the vicinity of the sliding contacts and can be transmitted by the signal converter, via the sliding contacts, to a position and process control as a serial data transmission telegram.

A further feature of the present invention is that the horizontal drive (x) and the storage/retrieval drive (z) are both connected to the same power regulator and the same speed control, and perform position and process control using a shared superordinated control.

Another feature of the present invention is that a change-over switch is associated with the drive regulators for the horizontal drive (x) and the storage/retrieval drive (z), which, when controlled through the superordinated control, switches between the horizontal drive (x) and the storage/retrieval drive (z).

A particular advantage of the control system according to the present invention is attained via contact conductors to the lift truck through a parameter change-over between travel and storage/retrieval. Here it is advantageous that the drive regulator or the speed control for the horizontal drive (x) and the storage/retrieval drive (z) are operable based on a set of control parameters. The control parameters are either transmitted during a change-over by the superordinated control or are stored in the drive regulator and speed control and can be activated by a change-over command from the superordinated control.

This type of drive control mechanism, with a shared drive regulator and speed control for the movement along the x and z axes, saves the expense of having a separate drive regulator and speed control for the z-direction. In addition, because movement along the z-axis is only permitted when the x-axis is turned off, in terms of drive, no loss of handling power is experienced in the shelf storage and retrieval device. The mass to be moved by the storage/retrieval drive (z) is always smaller than the mass moved by the horizontal drive (x), and thus, the power of the drive regulator for the horizontal drive (x) is always sufficient to move the mass of the storage/retrieval drive (z) in this arrangement. It is therefore advantageous that the connection between the superordinated control and the speed control or the power regulator for one of the horizontal drive, the storage/retrieval drive and the lift drive is designed as a serial data bus, via which the parameter sets, as well as the target speed values and the control data can be transmitted.

Furthermore, it is advantageous that each drive, which includes a motor, a power regulator, a speed control and a position control, can be coordinated through a superordinated control during the movement sequence of the transport and storage function of the device.

An example of the invention is shown in the attached drawings and described below in greater detail.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENT

Figure 1:
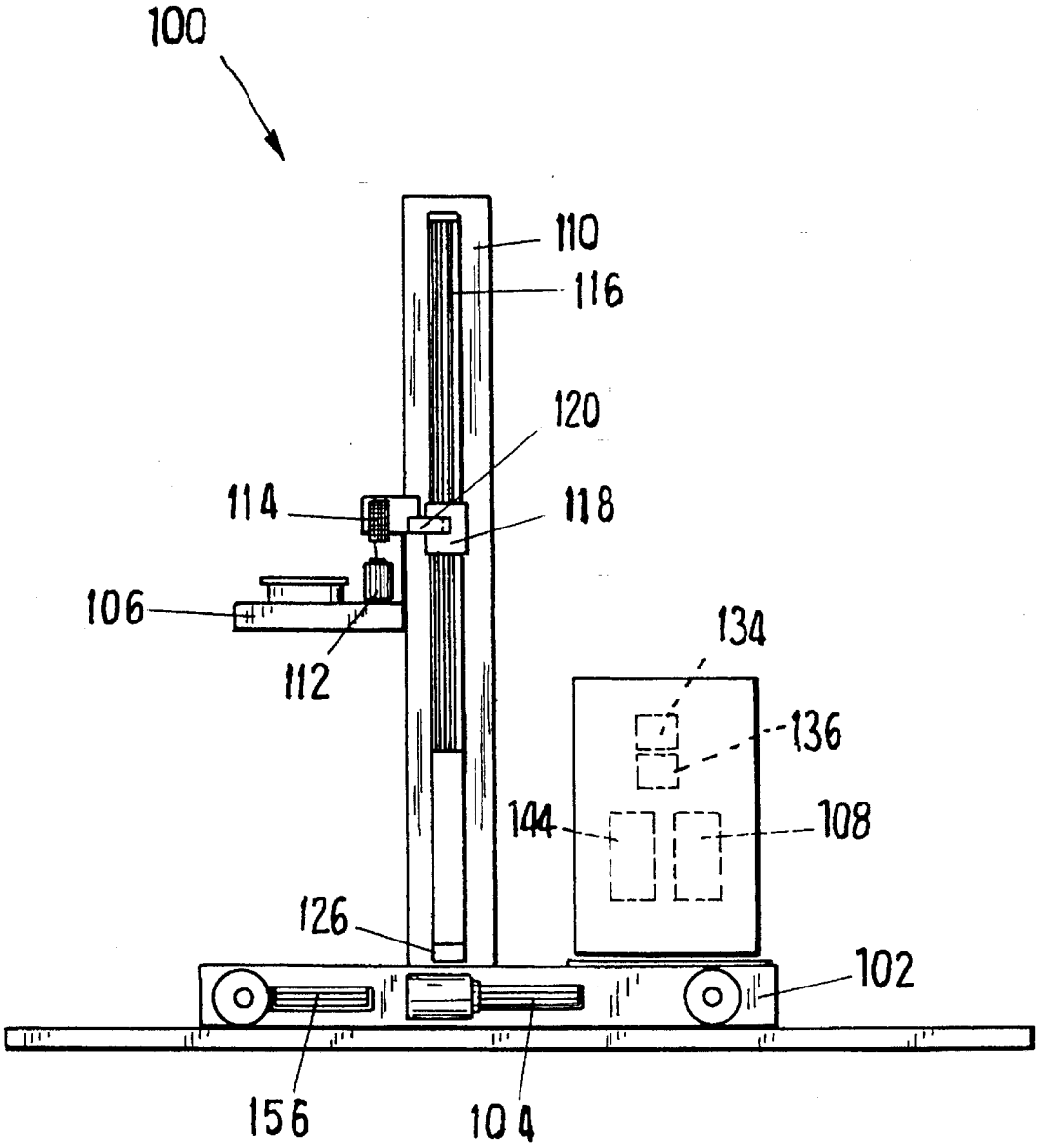
FIG. 1 illustrates a schematic side view of a shelf storage and retrieval device according to the present invention.

A control system included on a materials-handling device 100, especially for a shelf storage and retrieval device is shown in FIG. 1. This device 100 includes a horizontal travelling mechanism 102 having a horizontal drive 104, a lift truck 106 which can be raised and lowered via a lifting drive 108, shown in FIG. 3, on a mast 110, and a storage/retrieval drive 112 for the goods (not shown) to be handled.

Figure 4:
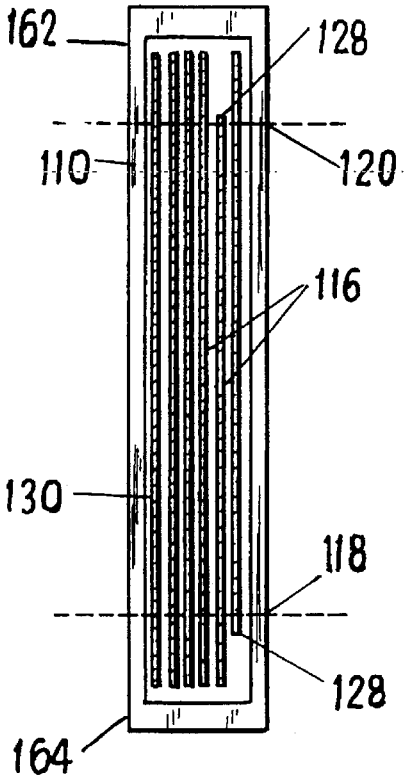
FIG. 4 illustrates the contact conductor arrangement on the mast of the shelf storage and retrieval device according to the present invention.
Figure 5:
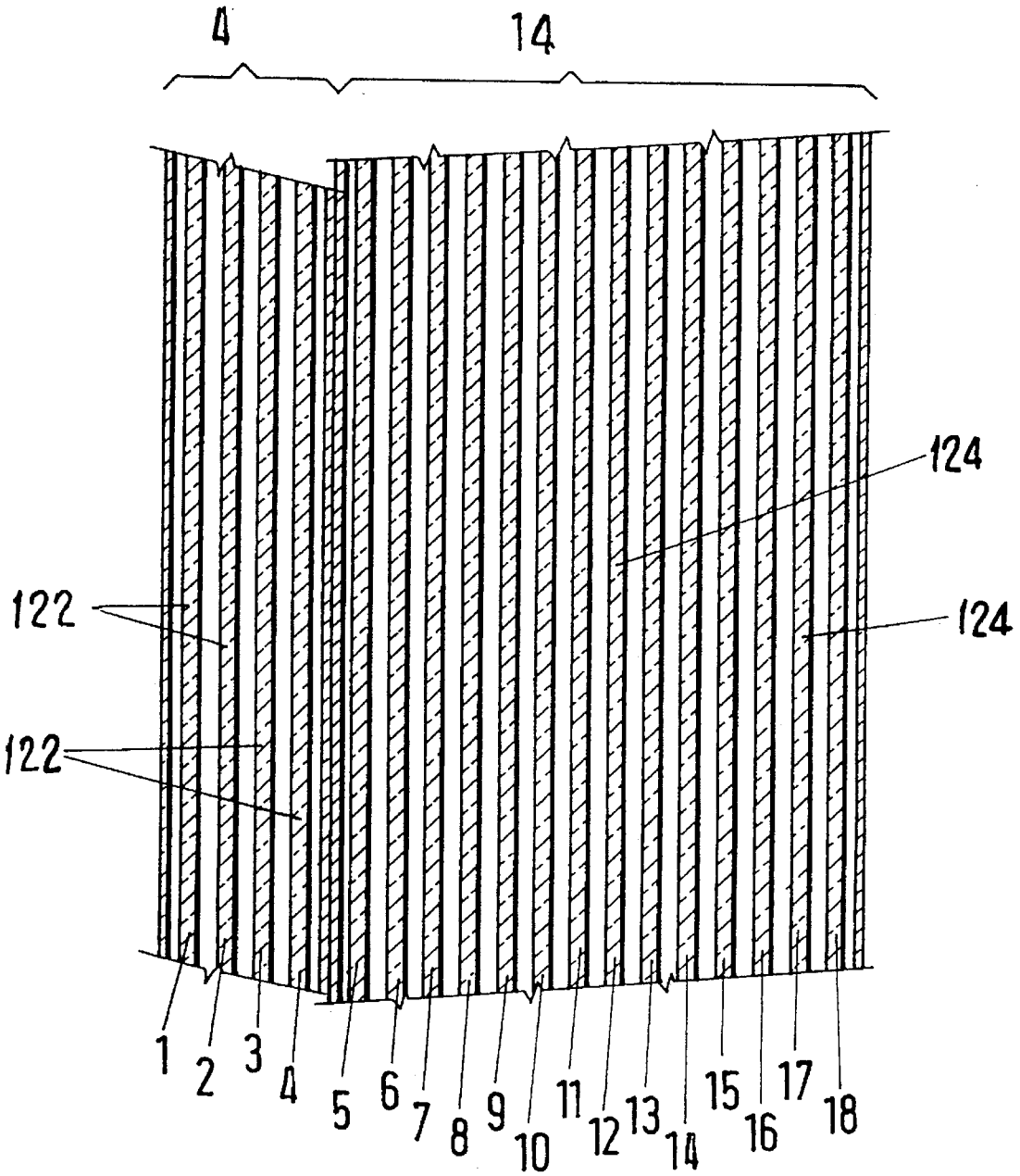
FIG. 5 illustrates a section of the contact conductor arrangement of FIG. 4 in enlarged series.

The electrical power for the storage/retrieval drive 112 and for a signal converter 114 is supplied by contact conductors 116 arranged on the mast 110. The contact conductors 116 can be more clearly seen in FIGS. 4 and 5 and will be further discussed hereinafter. The supplied power can be picked up from the contact conductors 116 by sliding contacts 118 on the lift truck 106. The sliding contacts 118 may be comprised of spring activated carbon strips connected to a guidance frame 120 of the lift truck 106. The carbon strips or sliding contacts 118 are coupled between the contact conductors 116 and both the storage/retrieval drive 112 and the signal converter 114 for supplying power between the contact conductors 116 and both the storage retrieval drive 112 and the signal converter 114. The lift drive 108 is also supplied with power from the contact conductors 116 through the sliding contacts 118. Power is supplied to any or all of the devices connected to the sliding contacts based upon the connections established between the sliding contacts 118 and the contact conductors 116. As the sliding contacts 118 are connected to the storage/retrieval drive 112, the signal converter 114, and the lift drive 108, power is supplied to the particular device or devices for which the sliding contacts 118 establish a connection with the contact conductors 116. The contact conductors 116 comprise parallel adjacent contact conductors 122 for motor currents and contact conductors 124 for control currents and data transmission signals as is shown in FIG. 5. The electrical connection between the mast 110 and the horizontal travelling mechanism 102 is established through a connector 126 at a base of the mast 110, as can be seen in FIG. 1. The connector is arranged at the lower end 128 of the contact conductors 116 shown in FIG. 4. As is also shown in FIG. 4, the contact conductor path 130 includes contact conductors of differing length, as will be explained in more detail below.

Figure 3:
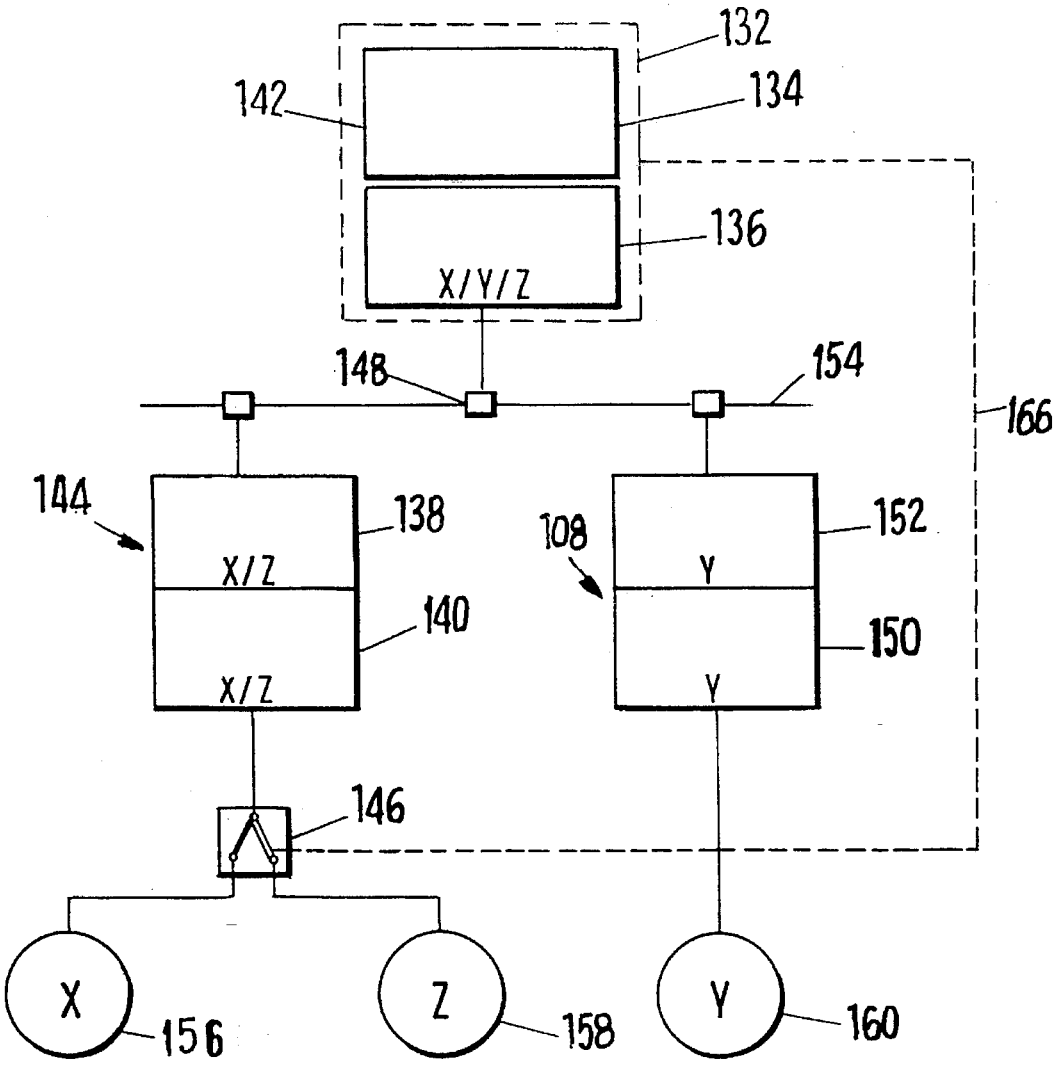
FIG. 3 is a block diagram illustrating the overall control system of the present invention.

The signals of the lift truck 104 are transmitted by the signal converter 114 positioned in the vicinity of the sliding contacts 118, to a position and process control 132 shown in FIG. 3. The position and process control 132 includes a process control 134 and a position control 136 for the respective axes, x, y, and z. The horizontal drive 104 and the storage/retrieval drive 112 are both attached to the same power regulator 138 and the same speed control 140. The position and process control 132 is carried out by a shared superordinated control 142 within the position and process control 132.

A drive regulator 144, including both the power regulator 138 and speed control 140 for both the horizontal drive 104 and the storage/retrieval drive 112, is associated with a change-over switch 146, which is controlled through control signals received along the line 166 from the superordinated control 142. The change-over switch 140 selects between the horizontal drive 104 and the storage/retrieval drive 112 depending on control signals generated by the position and process control 132.

The power regulator 138 and the speed control 140 for both the horizontal drive 104 and the storage/retrieval drive 112 are operable based on a set of control parameters, which may be transmitted during a change-over by the superordinated control 142 or may even be stored in the power regulator 138 or the speed control 140, and are activated by a change-over command from the superordinated control 142. A connection 148 between the superordinated control 142 and the speed control 138 or the power regulator 140 for the horizontal drive 104 and the storage/retrieval drive 112, and the speed control 150 or power regulator 152 for the lifting drive 108 exists along a serial data bus 154. The parameter sets, the speed target values and the control data can all be transmitted via this data bus 154.

Figure 2:
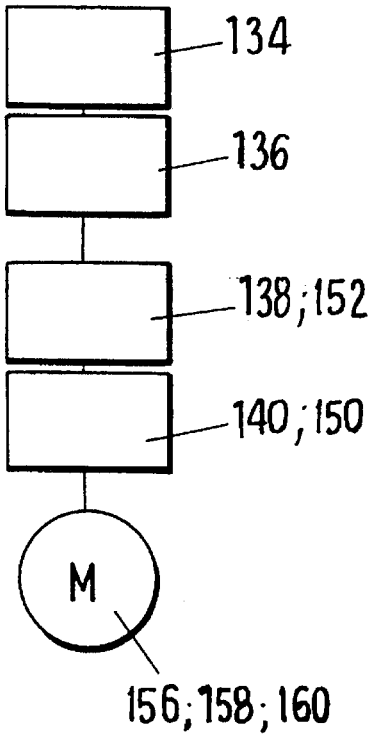
FIG. 2 is a block diagram illustrating the motor control system of the present invention.

Each drive, as shown in FIG. 2, includes a motor 156, 158; or 160, a power regulator 138; 152, a speed control 140, 150 and a position control 136 and can be coordinated through the superordinated control 142 during the movement sequence of the transport and storage function of the device.

As shown in FIG. 4, the conductive contact-conductor path 130 of a contact conductor 116 may be shortened at the upper end 162 of the mast 110, and the same contact conductor or a different contact conductor 116 may be shortened at the lower end 164 of the mast 110, so that the conductive section limits the movement area for raising and lowering by interrupting the control current circuit.

The signal converter 114, which includes line connections for the signals, is equipped with signal displays and converts the parallel signals into a serial transmission telegram. The signal converter 114 is located on the lift truck 104, as is shown in FIG. 1.

The contact conductors 122 which supply the motor power are surrounded by protective conductors, so that a screening effect can be maintained with respect to the closely adjacent contact conductors 124 for control currents and data transmission signals. Such can be seen in FIG. 5 and will be further discussed below.

As is shown in FIG. 5, previous contact conductor arrangements for shelf storage and retrieval devices, which include approximately 140 leads, are reduced to a total of only 18 contact conductors under the principle of the contact conductors used in the present invention. The especially interference-critical data bus contact conductors (identified by reference numbers 15 to 18 in FIG. 5), on which, for example, only currents of approximately 50 milliamperes flow at ±24 V, are spatially separated from the lines which conduct the motor power, in order to keep interference effects low (problem of electromagnetic compatibility).

The inventive arrangement of the contact conductors, for example, in the arrangement in FIG. 5 with the contact conductor of only 18-poles, was selected in such a way that the lines conducting the motor power (designated by reference numbers 2 to 4 in FIG. 5), which usually transmit several kW, are surrounded by the aforementioned protective conductors (designated by reference numbers 1 and 5 in FIG. 5). The protective conductors provide a screening effect to the closely adjacent signal and data lines.

The intermediate space between the power contact conductors and the data transmission contact conductors is utilized to supply power for the other current consumers of the lift truck 104, e.g., for final controls, electric brakes and separately controlling drives.

The invention is not limited by the embodiments described above which are presented as examples only but can be modified in various ways within the scope of protection defined by the appended patent claims.

We claim:

1. A system for controlling a materials-handling device including a horizontal travelling mechanism; a horizontal drive mounted on said travelling mechanism; a vertical mast connected to the horizontal travelling mechanism; a lift truck, being moveable along the mast; a lifting drive; a storage/retrieval drive attached to the lifting drive; and a signal converter for transmitting data signals, wherein the system comprises:

a plurality of contact conductors extending along the mast; and sliding contact means, positioned on the lift truck, for establishing an electrical connection between at least one of the plurality of contact conductors of the device and at least one of the storage/retrieval drive, the lifting drive and the signal converter.

2. The system as claimed in claim 1, wherein the lift truck further includes a guidance frame and the sliding contacts comprise spring-activated carbon strips which are connected to the guidance frame.

3. The system as claimed in claim 1, further comprising a connector means, positioned at a lower end of the contact conductors, for establishing an electrical connection between the mast and the horizontal travelling mechanism.

4. The system as claimed in claim 1, wherein a conductive contact-conductor path of at least one of the plurality of contact conductors is shortened at an upper end thereof and at least one of the plurality of contact conductors is shortened at a lower end thereof, and the shortened conductive contact-conductor path limits a movement area for at least one of raising and lowering the lift truck by the lifting device through the interruption of the contact between the sliding contact means and the plurality of contact conductors.

5. The system as claimed in claim 1, wherein the signal converter includes line connections for signals, signal displays, and means for converting parallel signals into a serial data transmission telegram.

6. The system as claimed in claim 1, wherein the contact conductors include motor current conductors, protective conductors and control current conductors, whereby the motor current conductors are surrounded by the protective conductors such that the protective conductors provide a screening effect for the control current conductors and data signals transmitted by the signal converter.

7. The system as claimed in claim 1, wherein the mast includes an insulating profile of the contact conductors, the contact conductors being rectangular in cross-section and whereby a minimal distance exists both between adjacent contact conductors and between the contact conductors and the conductive mast.

8. The system as claimed in claim 1, wherein the contact conductors include parallel adjacent contact conductors for providing power for transmission of motor currents, control currents and data transmission signals.

9. The system as claimed in claim 1, further comprising a position and process control wherein signals from the lift truck are transmitted by the signal converter to the position and process control as a serial data transmission telegram.

10. The system as claimed in claim 1, further comprising a shared superordinated control, a first power regulator and a first speed control wherein the horizontal drive and the storage/retrieval drive are both connected to the first power regulator and the first speed control and that position and process control is carried out by the shared superordinated control.

11. The system as claimed in claim 10, further comprising a change-over switch and a drive regulator, the drive regulator being connected to both the horizontal drive and storage retrieval drive through the change-over switch, wherein the change-over switch is controlled through the superordinated control, and provides a connection between one of the horizontal drive, the storage/retrieval drive and the drive regulator based upon control signals received from the superordinated control.

12. The system as claimed in claim 11, wherein the first power regulator and the first speed control are operable based on a set of control parameters, transmitted during a change-over by the superordinated control, and are activated upon receipt of a change-over command from the superordinated control.

13. The system as claimed in claim 11, wherein the first power regulator and the first speed control are operable based on a set of control parameters stored in one of the first power regulator and first speed control, the control parameters being activated upon receipt of a change-over command from the superordinated control.

14. The system as claimed in claim 12, further comprising a serial data bus and a connector and the lift drive further includes a second speed control and second power regulator connected to the lift drive, wherein the connector couples the superordinated control; one of the first speed control and first power regulator; and one of the second speed control and second power regulator to the serial data bus whereby parameter sets, target speed values and control data are transmitted along the serial data bus.

15. The system as claimed in claim 13, further comprising a serial data bus and a connector and the lift drive further includes a second speed control and second power regulator connected to the lift drive wherein the connector couples the superordinated control; one of the first speed control and first power regulator; and one of the second speed control and second power regulator to the serial data bus whereby parameter sets, target speed values and control data are transmitted along the serial data bus.

16. The system as claimed in claim 14, wherein the horizontal drive, the storage retrieval drive and the lift drive each further include a motor and a position control, and each are coordinated through the superordinated control in the movement sequence of the transport and storage function of the device.

17. The system as claimed in claim 15, wherein the horizontal drive, the storage/retrieval drive and the lift drive each further include a motor and a position control, and each are coordinated through the superordinated control in the movement sequence of the transport and storage function of the device.

18. A materials-handling device comprising:

a horizontal travelling mechanism;

a horizontal drive mounted on said travelling mechanism;

a mast connected to the horizontal travelling mechanism;

a lift truck movable along the mast;

a lifting drive;

a storage/retrieval drive attached to the lifting drive;

a signal converter for transmitting signals;

a plurality of contact conductors extending along the mast; and sliding contact means positioned on the lift truck for establishing an electrical connection between at least one of the plurality of contact conductors, and at least one of the storage/retrieval drive, the lifting drive and the signal converter.

* * * * *